US011183781B2

(12) United States Patent
Komoto et al.

(10) Patent No.: US 11,183,781 B2
(45) Date of Patent: Nov. 23, 2021

(54) CONNECTOR

(71) Applicant: Japan Aviation Electronics Industry, Limited, Tokyo (JP)

(72) Inventors: Tetsuya Komoto, Tokyo (JP); Seiya Matsuo, Tokyo (JP); Osamu Hashiguchi, Tokyo (JP); Akira Kimura, Tokyo (JP); Akihiro Matsunaga, Tokyo (JP); Takahiro Shimotori, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/929,820

(22) Filed: Jul. 15, 2020

(65) Prior Publication Data

US 2021/0098903 A1 Apr. 1, 2021

(30) Foreign Application Priority Data

Sep. 26, 2019 (JP) ..... JP2019-174946

(51) Int. Cl.
*H01B 9/02* (2006.01)
*H01R 9/22* (2006.01)
*H01R 9/24* (2006.01)

(52) U.S. Cl.
CPC ..... *H01R 9/223* (2013.01); *H01R 9/2416* (2013.01)

(58) Field of Classification Search
CPC ..... H01R 4/58; H01R 9/223; H01R 9/2416; H01R 12/771; H01R 13/03; H01R 13/642
USPC ..... 439/37, 678, 677, 909
See application file for complete search history.

(56) References Cited

U.S. PATENT DOCUMENTS 3,805,117 A * 4/1974 Hausman ..... H05K 1/145 361/743
3,961,228 A * 6/1976 Briggs ..... H05K 1/142 361/803
4,480,888 A * 11/1984 Hopkins ..... H01R 12/82 439/263

(Continued)

FOREIGN PATENT DOCUMENTS

JP 2018129244 A 8/2018

OTHER PUBLICATIONS

Extended European Search Report dated Oct. 27, 2020 in EP Application No. 20188429.3 (12 pages).

*Primary Examiner* — William H. Mayo, III
(74) *Attorney, Agent, or Firm* — Muncy, Geissler, Olds & Lowe, P.C.

(57) ABSTRACT

A connector includes a base member having a projection, a contact made of a conductive material and having a projection accommodating portion of a recess shape into which the projection is inserted, and a housing holding the contact. The housing has a holding mechanism configured to hold a flexible conductor disposed to extend across an opening end portion of the projection accommodating portion of the contact. When the projection of the base member is inserted into the projection accommodating portion of the contact together with the flexible conductor held by the holding mechanism, the flexible conductor is sandwiched between a lateral surface of the projection and an inner surface of the projection accommodating portion to contact the inner surface of the projection accommodating portion. The contact is electrically connected to the flexible conductor.

12 Claims, 9 Drawing Sheets

(56) References Cited

U.S. PATENT DOCUMENTS

| | | | | |
|---|---|---|---|---|
| 8,622,753 | B2 * | 1/2014 | Balzano | H01R 12/59 439/67 |
| 8,708,712 | B2 * | 4/2014 | Iida | H05K 3/365 439/67 |
| 9,466,905 | B2 * | 10/2016 | Mizoguchi | H05K 3/341 |
| 10,923,855 | B2 * | 2/2021 | Matsuo | A41D 1/005 |
| 2012/0037402 | A1 * | 2/2012 | Kawase | H01R 4/2433 174/135 |
| 2016/0156129 | A1 * | 6/2016 | Liu | H05K 5/0247 439/371 |
| 2018/0233854 | A1 * | 8/2018 | Komoto | H01R 12/58 |

* cited by examiner

CONNECTOR

BACKGROUND OF THE INVENTION

The present invention relates to a connector, particularly to a connector connected to a flexible conductor.

As the connector connected to a flexible conductor, for example, JP2018-129244A discloses a connector as illustrated in FIG. 16. This connector includes a contact 2 and a base member 3 that are disposed on the opposite sides across a flexible substrate 1 to sandwich the flexible substrate 1 therebetween.

A flexible conductor 4 is exposed on the flexible substrate 1 on the side facing the contact 2, the contact 2 has a projection accommodating portion 5 of a recess shape formed to face the flexible conductor 4, and a projection 6 is formed on the base member 3 to project toward the bottom of the flexible substrate 1. When the projection 6 of the base member 3 is, together with the flexible substrate 1, inserted into the projection accommodating portion 5 of the contact 2 with the flexible substrate 1 being sandwiched between the projection 6 and the contact 2 such that the projection 6 is covered by the flexible substrate 1, the flexible substrate 1 is pressed against the inner surface of the projection accommodating portion 5 of the contact 2 by the projection 6, and the inner surface of the projection accommodating portion 5 makes contact with the flexible conductor 4 exposed on the surface of the flexible substrate 1 accordingly, whereby the contact 2 is electrically connected to the flexible conductor 4.

Meanwhile, when the projection 6 of the base member 3 together with the flexible substrate 1 is inserted into the projection accommodating portion 5 of the contact 2, the flexible substrate 1 readily moves relative to the projection 6, causing a problem that the connection process for connecting the connector comprising the contact 2 and the base member 3 to the flexible conductor 4 becomes difficult.

In particular, when the flexible conductor 4 has a width dimension smaller than that of the projection 6, the projection 6 and the flexible conductor 4 need to be inserted into the projection accommodating portion 5 of the contact 2 while their relative position where the flexible conductor 4 extends across a top of the projection 6 is maintained, which makes the connection process for connecting the connector to the flexible conductor 4 more difficult. In addition, if the flexible conductor 4 moves off from the position relative to the projection 6, reliability of electrical connection between the flexible conductor 4 and the contact 2 may be impaired.

SUMMARY OF THE INVENTION

The present invention has been made to solve the foregoing problem and aims at providing a connector that can be readily connected to a flexible conductor and can ensure the reliability of electrical connection to the flexible conductor.

A connector according to the present invention is a connector to be connected to a flexible conductor, the connector comprising:

a base member having a projection;

a contact made of a conductive material and having a projection accommodating portion of a recess shape into which the projection is inserted; and a housing holding the contact, wherein the housing has a holding mechanism configured to hold the flexible conductor disposed to extend across an opening end portion of the projection accommodating portion of the contact, and wherein when the projection of the base member is inserted into the projection accommodating portion of the contact together with the flexible conductor held by the holding mechanism, the flexible conductor is sandwiched between a lateral surface of the projection and an inner surface of the projection accommodating portion to contact the inner surface of the projection accommodating portion, whereby the contact is electrically connected to the flexible conductor.

DETAILED DESCRIPTION OF THE INVENTION

An embodiment of the present invention is described below with reference to the accompanying drawings.

Figure 1:
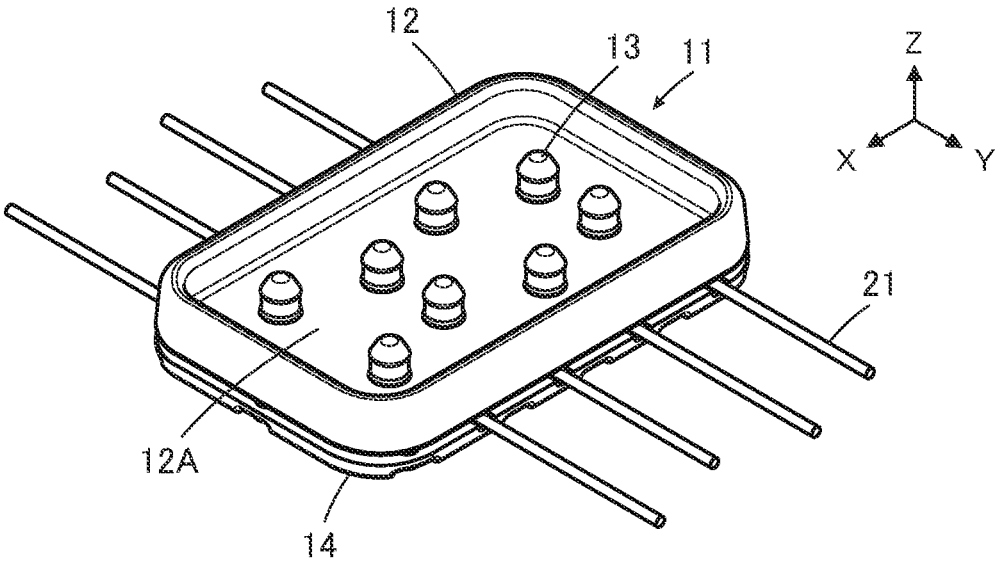
FIG. 1 is a perspective view showing a connector according to an embodiment of the present invention when viewed from an obliquely upper position.
Figure 2:
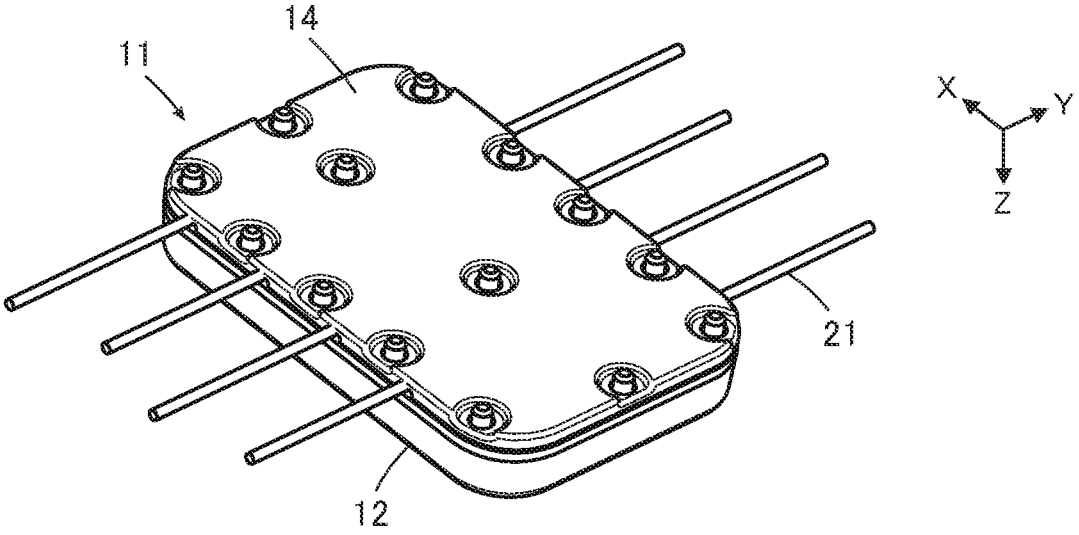
FIG. 2 is a perspective view showing the connector according to the embodiment when viewed from an obliquely lower position.

FIGS. 1 and 2 illustrate a connector 11 according to the embodiment. The connector 11 is used as, for example, a garment-side connector portion for fitting a wearable device and is connected to a plurality of flexible conductors 21.

The connector 11 includes a housing 12, a plurality of contacts 13, and a base member 14 that faces the housing 12 with the plurality of flexible conductors 21 being sandwiched therebetween, and the plurality of contacts 13 are electrically connected to the plurality of flexible conductors 21. The housing 12 includes a recess 12A, and in the recess 12A of the housing 12, the contacts 13 project perpendicularly to a flat bottom surface of the recess 12A.

The flexible conductors 21 are produced using a conductive yarn formed by twisting a plurality of conductive fibers.

For convenience, the bottom surface of the recess 12A of the housing 12 is defined as extending along an XY plane, and the direction in which the contacts 13 project is referred to as "+Z direction."

As the contacts 13, provided are four pairs of contacts 13 arranged in the X direction, and two contacts 13 in each pair are aligned in the Y direction.

Figure 3:
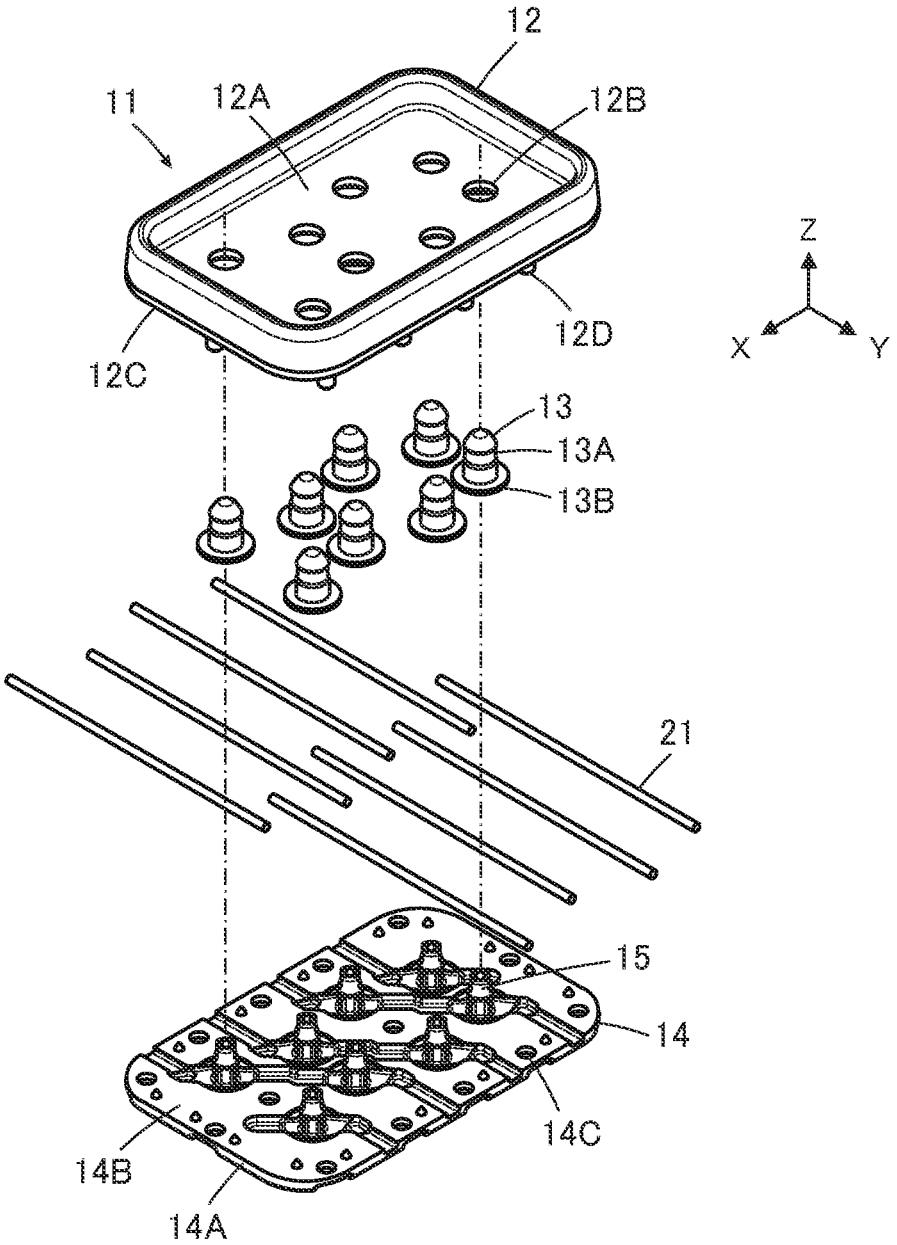
FIG. 3 is an assembly view showing the connector according to the embodiment when viewed from obliquely upper position.
Figure 4:
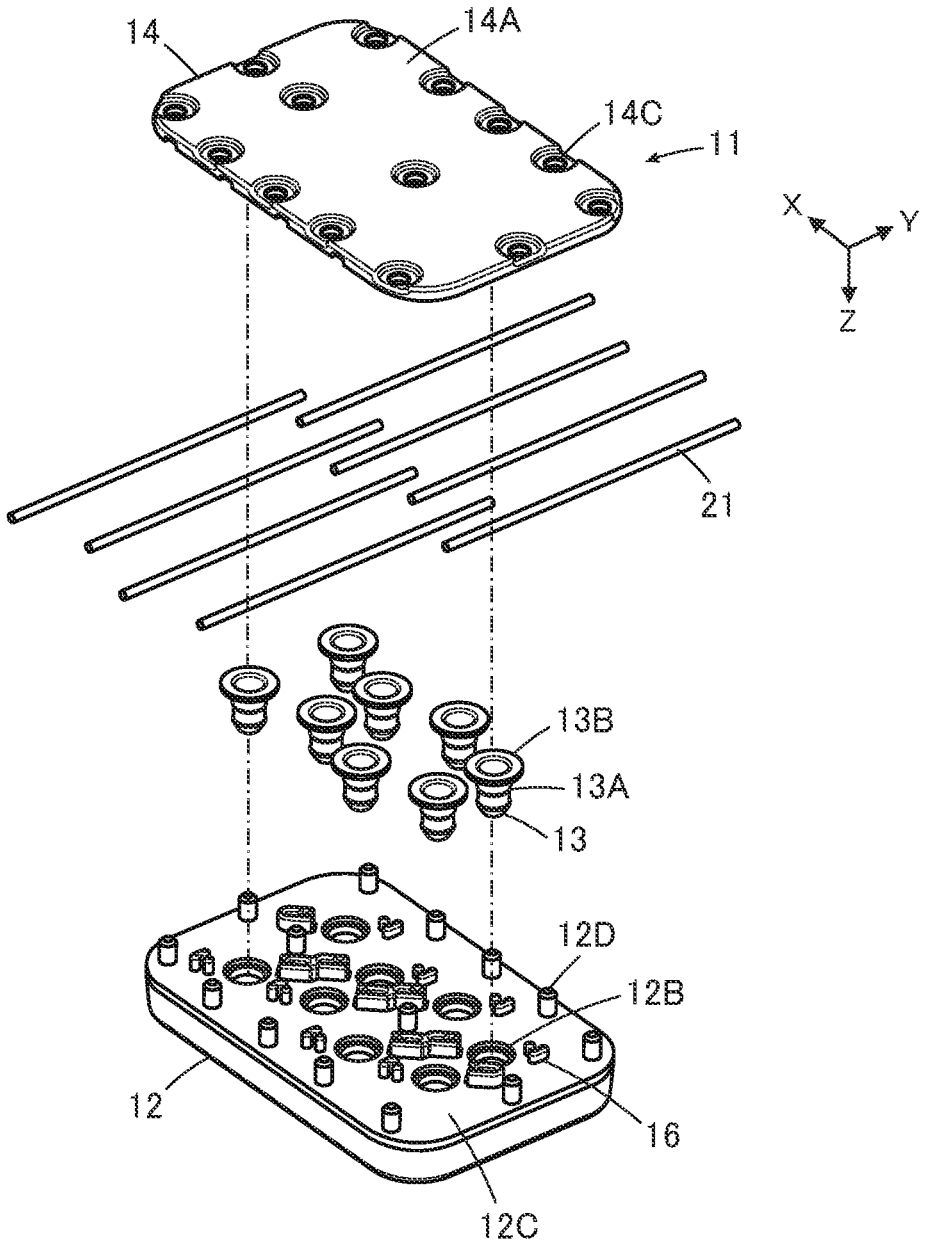
FIG. 4 is an assembly view showing the connector according to the embodiment when viewed from an obliquely lower position.

FIGS. 3 and 4 are assembly views of the connector 11. The housing 12 is made of an insulating material such as an insulating resin, and a plurality of contact through-holes 12B are formed in the recess 12A opening in the +Z direction. The recess 12A constitutes a counter-connector accommodating portion in which a part of a counter connector (not shown) is to be accommodated. The contact through-holes 12B separately correspond to the contacts 13. A rear surface on the −Z direction side of the housing 12 forms a housing-side facing surface 12C that faces the base member 14, and a plurality of bosses 12D are formed on the housing-side facing surface 12C to project in the −Z direction.

The contacts 13 are plug-type contacts made of a conductive material such as metal, and are to be connected to corresponding contacts of a counter connector (not shown) when a part of the counter connector is accommodated in the recess 12A of the housing 12. Each contact 13 has a tubular portion 13A of a cylindrical shape extending in the Z direction and a flange 13B extending from the −Z directional end of the tubular portion 13A along an XY plane.

The base member 14 is made of an insulating material such as an insulating resin and includes a flat plate portion 14A. The flat plate portion 14A includes a front surface 14B facing in the +Z direction so as to face the housing-side facing surface 12C of the housing 12, and a plurality of projections 15 are formed on the front surface 14B to project therefrom. The projections 15 separately correspond to the contacts 13.

In addition, a plurality of boss accommodating holes 14C corresponding to the bosses 12D of the housing 12 are formed in the flat plate portion 14A.

The contact through-holes 12B of the housing 12, the contacts 13, the flexible conductors 21 and the projections 15 of the base member 14 are arranged so as to align with each other in the Z direction.

Similarly, the bosses 12D of the housing 12 and the boss accommodating holes 14C of the base member 14 are arranged so as to align with each other in the Z direction.

The contact through-holes 12B of the housing 12 have an inside diameter larger than the outside diameter of the tubular portions 13A of the contacts 13 and smaller than the outside diameter of the flanges 13B to allow smooth insertion of the tubular portions 13A of the contacts 13.

Further, the boss accommodating holes 14C of the base member 14 have an inside diameter equal to or slightly smaller than the outside diameter of the bosses 12D of the housing 12, and by press-fitting the bosses 12D into the boss accommodating holes 14C, the housing 12 and the base member 14 are fixed to each other.

As illustrated in FIG. 4, the housing 12 includes a plurality of holding mechanisms 16 that are disposed on the housing-side facing surface 12C so that the holding mechanisms 16 separately correspond to the plurality of contact through-holes 12B. Each holding mechanism 16 is configured to hold the corresponding flexible conductor 21 and is arranged around the corresponding contact through-hole 12B.

Figure 5:
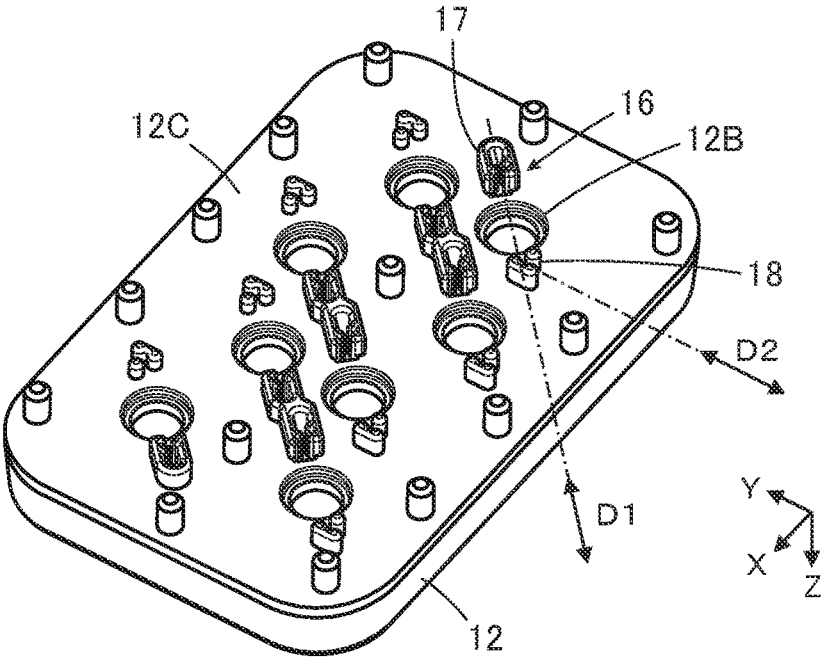
FIG. 5 is a perspective view showing a housing used in the connector according to the embodiment when viewed from an obliquely lower position.
Figure 6:
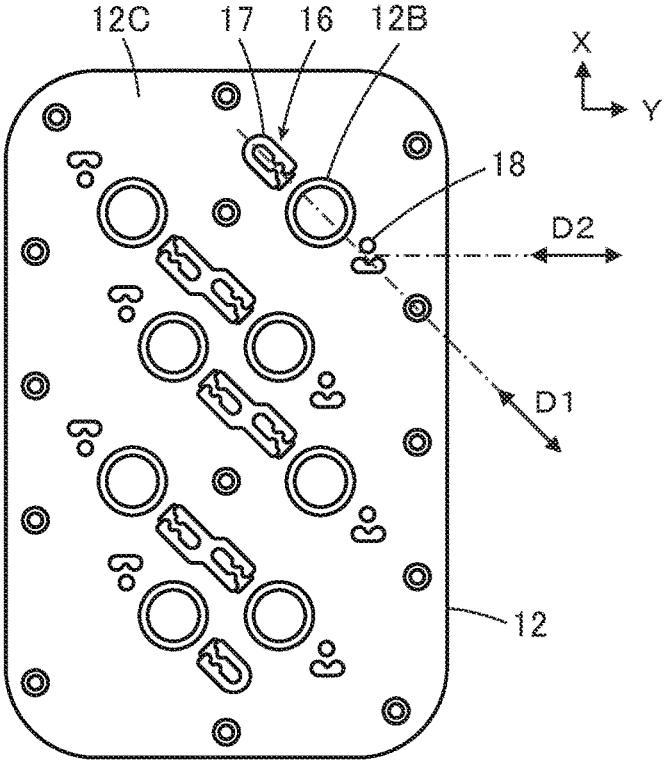
FIG. 6 is a bottom view of the housing used in the connector according to the embodiment.

As illustrated in FIGS. 5 and 6, each holding mechanism 16 includes a first holding portion 17 and a second holding portion 18 that are separately disposed on the opposite sides of the corresponding contact through-hole 12B so as to sandwich the corresponding contact through-hole 12B. On the housing-side facing surface 12C of the housing 12, the first holding portion 17 and the second holding portion 18 are disposed along a first direction D1 having an inclination angle of 45 degrees with respect to the X direction and the Y direction, while sandwiching the corresponding contact through-hole 12B.

The plurality of contact through-holes 12B formed in the housing 12 separately correspond to the plurality of contacts 13, two contact through-holes 12B adjacent to each other in the Y direction form a pair, and four pairs of contact through holes 12B are arranged in the X direction. For each contact through-hole 12B, the second holding portion 18 is disposed on, of the opposite edges of the housing 12, one edge side closer to the associated contact through-hole 12B, and the first holding portion 17 is disposed on the center side of the housing 12 in the Y direction.

The first holding portion 17 is configured to hold one end portion of the flexible conductor 21 disposed along the first direction D1, and the second holding portion 18 is configured to hold a middle portion of the flexible conductor 21 while bending the middle portion from the first direction D1 to a second direction D2 extending in the Y direction.

Figure 7:
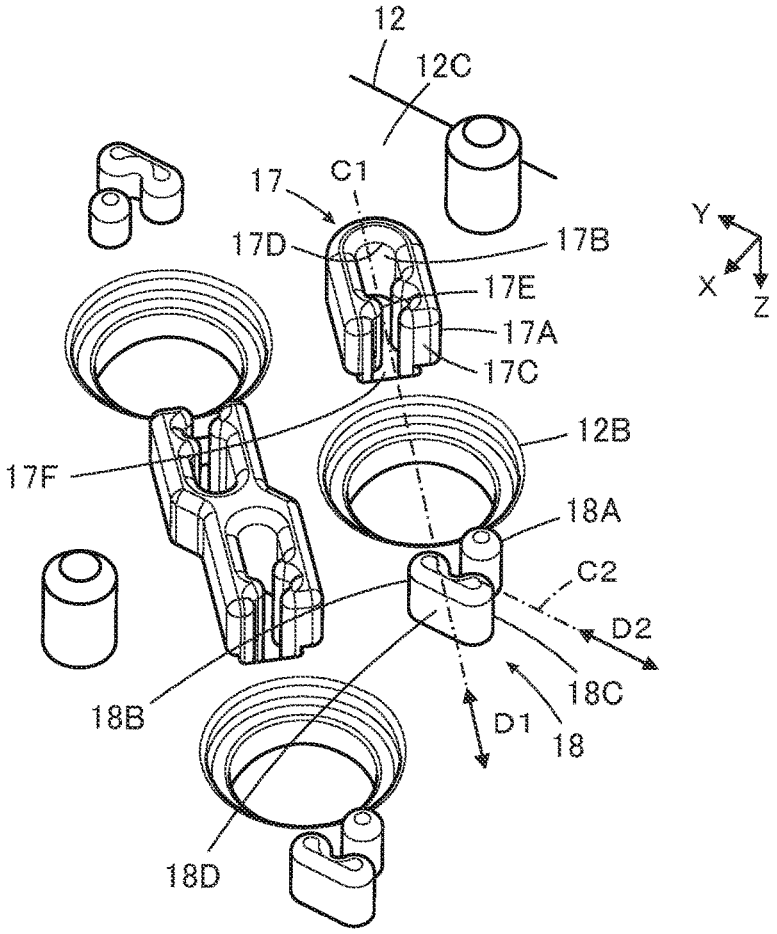
FIG. 7 is an enlarged partial view of FIG. 5.
Figure 8:
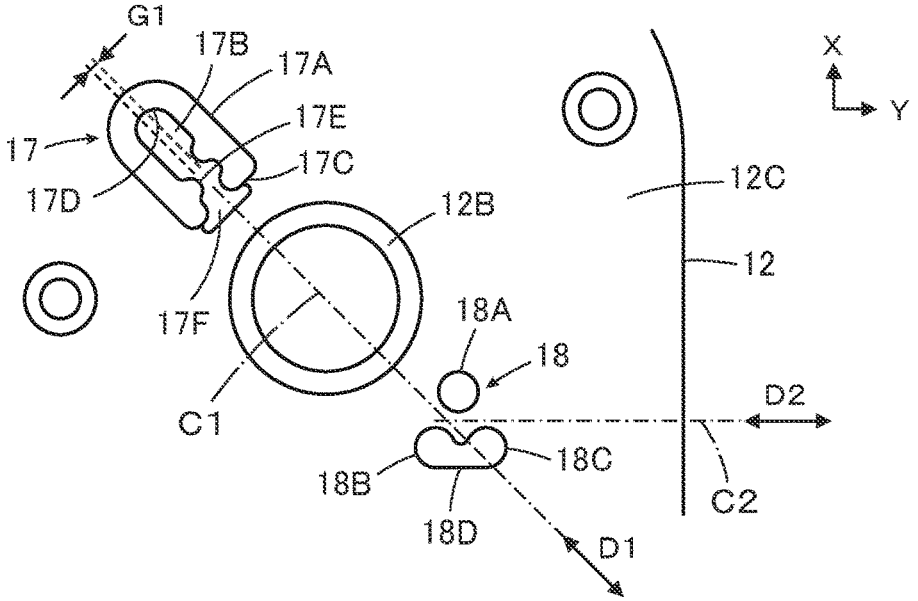
FIG. 8 is an enlarged partial view of FIG. 6.

As illustrated in FIGS. 7 and 8, the first holding portion 17 is formed along a central axis C1 extending in parallel to the first direction D1 and includes a wall portion 17A that forms a U shape having the central axis C1 as its center on the housing-side facing surface 12C and projects from the housing-side facing surface 12C in the −Z direction, and a conductor accommodating portion 17B in which one end portion of the flexible conductor 21 is to be accommodated is formed inside the wall portion 17A. On the housing-side facing surface 12C, an opening end portion 17C of the U shape of the wall portion 17A is directed to the corresponding contact through-hole 12B, and a closed end portion of the U shape of the wall portion 17A positioned on the opposite side of the opening end portion 17C along the central axis C1 is provided with a partition wall 17D projecting in the −Z direction.

An inner wall surface of the wall portion 17A is provided with three protruding portions 17E which are perpendicular to the first direction D1 and protrude toward the central axis C1. One of the three protruding portions 17E is disposed on one side of the central axis C1, and the remaining two protruding portions 17E are disposed on the other side of the central axis C1. More specifically, one protruding portion 17E and the remaining two protruding portions 17E are separately positioned on the opposite sides across the central axis C1 so as to sandwich the central axis C1.

In addition, the bottom of the conductor accommodating portion 17B is provided with a recessed portion 17F that is recessed in the +Z direction from the other portion of the housing-side facing surface 12C than the first holding portion 17.

On the other hand, the second holding portion 18 includes three columnar portions 18A to 18C projecting from the housing-side facing surface 12C in the −Z direction. Of the three columnar portions 18A to 18C, one columnar portion 18A is independently disposed, and the remaining two columnar portions 18B and 18C are integrally formed through a connecting portion 18D. The columnar portions 18B and 18C are arranged in the Y direction, and the columnar portion 18A is disposed at a position away from the center in the Y direction of the columnar portions 18B and 18C by a predetermined distance in the X direction, whereby the three columnar portions 18A to 18C are disposed at positions of vertices of a substantially equilateral triangle on the housing-side facing surface 12C.

Of the three columnar portions 18A to 18C, the columnar portions 18A and 18B each form a protruding portion which is perpendicular to the first direction D1 and protrudes toward the central axis C1 and, at the same time, is perpendicular to the second direction D2 and protrudes toward a central axis C2 extending in the second direction D2 in the XY plane. The columnar portion 18C forms a protruding portion which is perpendicular to the second direction D2 and protrudes toward the central axis C2 extending in the second direction D2 in the XY plane.

The three protruding portions 17E of the first holding portion 17 are separately disposed at positions different from each other in the first direction D1, a gap G1 of the three protruding portions 17E in a direction perpendicular to the first direction D1 is set to a dimension smaller than a width (diameter) dimension of the flexible conductor 21 held by the first holding portion 17. More specifically, the gap G1 in the width direction of the flexible conductor 21, between one protruding portion 17E, of the three protruding portions 17E, disposed on one side of the central axis C1 and the remaining two protruding portions 17E disposed on the other side of the central axis C1 is smaller than the width (diameter) dimension of the flexible conductor 21.

Similarly, the three protruding portions formed by the three columnar portions 18A to 18C of the second holding portion 18 are disposed at positions different from each other in both the first direction D1 and the second direction D2. Further, a gap in the direction perpendicular to the first direction D1, between the two protruding portions formed by the columnar portions 18A and 18B of the second holding portion 18 is also set to the gap G1 smaller than the width (diameter) dimension of the flexible conductor 21, and a gap in a direction perpendicular to the second direction D2, between the three protruding portions formed by the columnar portions 18A to 18C is also set to the gap G1 smaller than the width (diameter) dimension of the flexible conductor 21.

Therefore, when the flexible conductor 21 is pressed to the first holding portion 17 and the second holding portion 18 from the −Z direction to the +Z direction, the flexible conductor 21 elastically deforms to be held by both the three protruding portions 17E of the first holding portion 17 and the three protruding portions formed by the three columnar portions 18A to 18C of the second holding portion 18.

Figure 9:
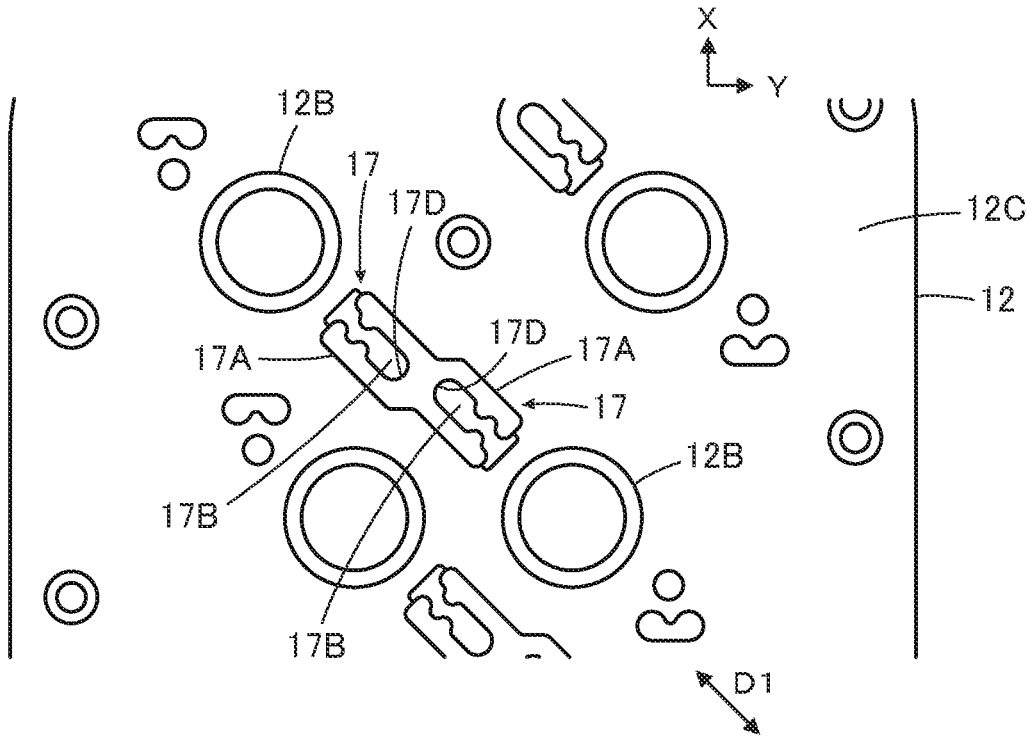
FIG. 9 is an enlarged partial view of FIG. 6.

As illustrated in FIG. 9, two first holding portions 17 corresponding to two contact through-holes 12B, of the plurality of contact through-holes 12B, disposed to overlap each other in the first direction D1 are close to each other in the vicinity of the center of the housing 12 in the Y direction and are integrally formed with the wall portions 17A of the two first holding portions 17 being connected with each other. However, the conductor accommodating portions 17B of the two first holding portions 17 are isolated from each other via their partition walls 17D.

Figure 10:
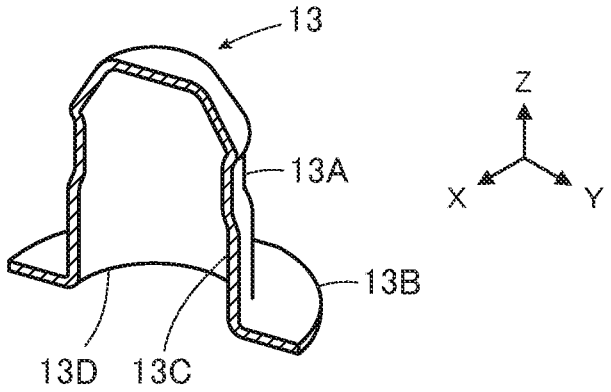
FIG. 10 is a cross-sectional perspective view showing a contact used in the connector according to the embodiment.

As illustrated in FIG. 10, the tubular portion 13A of the contact 13 has a cylindrical shape with its +Z directional end being closed, the flange 13B is formed integrally with the −Z directional end of the tubular portion 13A, and a projection accommodating portion 13C of a recess shape is formed in the tubular portion 13A. More specifically, the flange 13B is formed so as to surround an opening end portion 13D of the projection accommodating portion 13C.

The contact 13 as above can be manufactured by, for example, press working, cutting or drawing.

When the connector 11 is connected to the plurality of flexible conductors 21, the housing 12 is first placed on a surface of, for example, a workbench (not shown) with the housing-side facing surface 12C facing upward such that the +Z direction faces downward and the −Z direction faces upward as illustrated in FIG. 4, and the tubular portions 13A of the contacts 13 are inserted into the contact through-holes 12B of the housing 12 from above.

Figure 11:
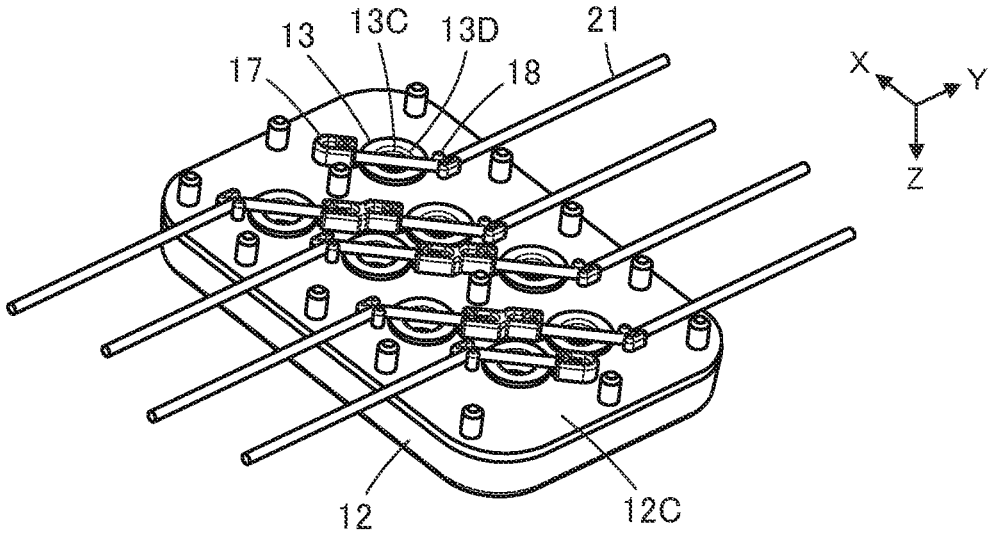
FIG. 11 is a perspective view showing the housing on which a plurality of flexible conductors are disposed, when viewed from an obliquely lower position.
Figure 12:
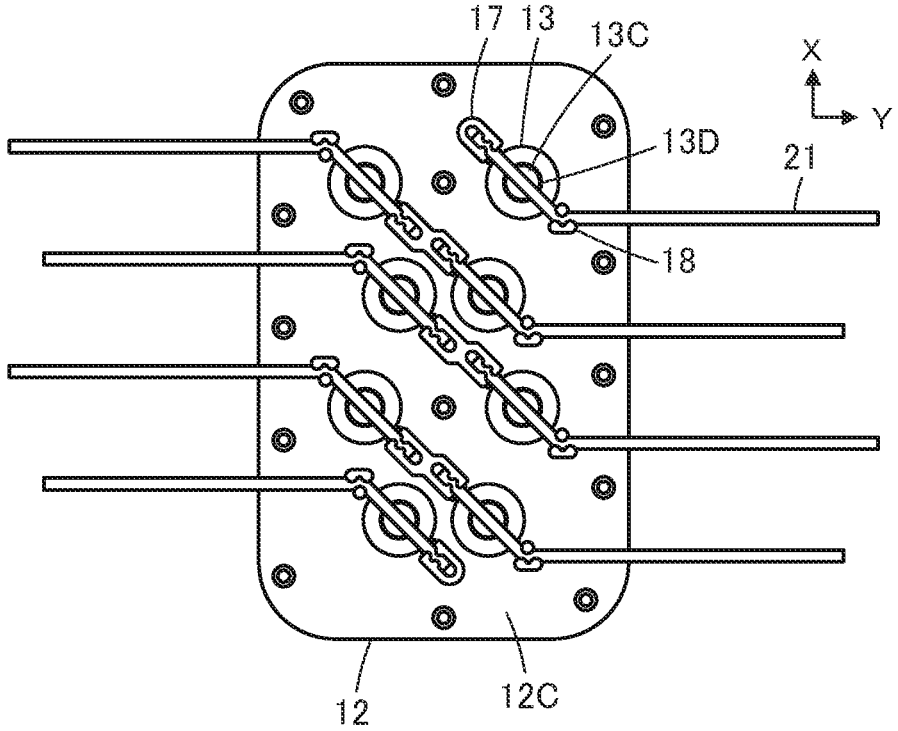
FIG. 12 is a bottom view of the housing on which the plurality of flexible conductors are disposed.

Therefore, as illustrated in FIGS. 11 and 12, the plurality of contacts 13 are disposed on the housing 12 while the projection accommodating portions 13C are exposed to face in the −Z direction.

Subsequently, each of the plurality of flexible conductors 21 is held by the first holding portion 17 and the second holding portion 18 separately disposed on the opposite sides of the corresponding contact through-hole 12B to sandwich the corresponding contact through-hole 12B. At this time, the flexible conductor 21 is pressed into the first holding portion 17 and the second holding portion 18 from the −Z direction to the +Z direction, whereby the flexible conductor 21 is disposed so as to extend across the opening end portion 13D of the projection accommodating portion 13C of the corresponding contact 13, and one end portion of the flexible conductor 21 is held by the first holding portion 17, and the middle portion of the flexible conductor 21 is held by the second holding portion 18.

Two flexible conductors 21 disposed to correspond to, of the plurality of contacts 13, two contacts 13 adjacent to each other in the Y direction and forming a pair, extend between the two contacts 13 in a direction, i.e., the first direction D1, crossing a straight line connecting the two contacts 13 in the Y direction. Therefore, even when the distance between the two contacts 13 which form a pair is short, the corresponding two flexible conductors 21 are effectively prevented from being electrically short-circuited.

Figure 13:
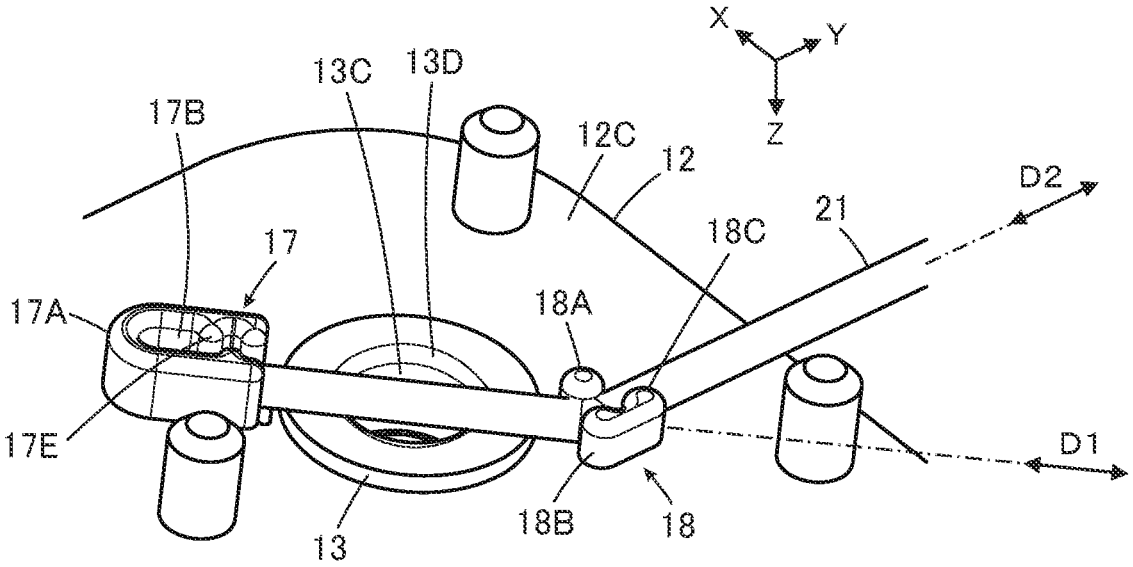
FIG. 13 is an enlarged partial view of FIG. 11.
Figure 14:
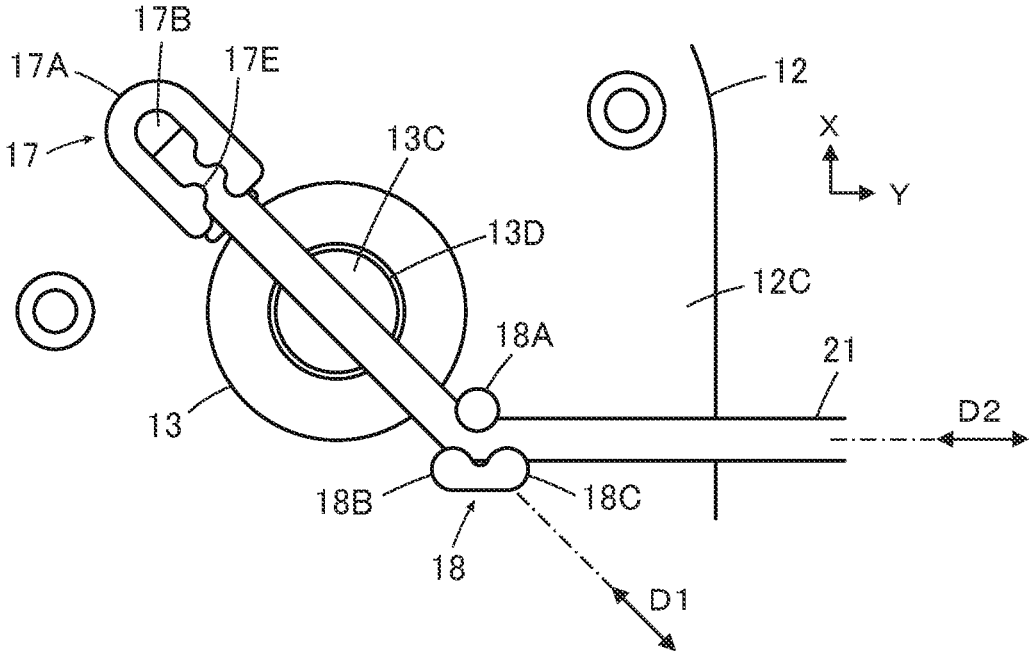
FIG. 14 is an enlarged partial view of FIG. 12.

As illustrated in FIGS. 13 and 14, the flexible conductor 21 extends in the first direction D1 while crossing the opening end portion 13D of the projection accommodating portion 13C of the contact 13 between the first holding portion 17 and the second holding portion 18, is bent by the three columnar portions 18A to 18C of the second holding portion 18 from the first direction D1 to the second direction D2 extending in the Y direction, and further extends toward the outside of the housing 12 in the second direction D2.

Since one end portion of the flexible conductor 21 is accommodated in the conductor accommodating portion 17B formed inside the wall portion 17A of the first holding portion 17, the one end portion of the flexible conductor 21 is prevented from moving due to some factors and being electrically short-circuited to the other flexible conductor 21.

Figure 15:
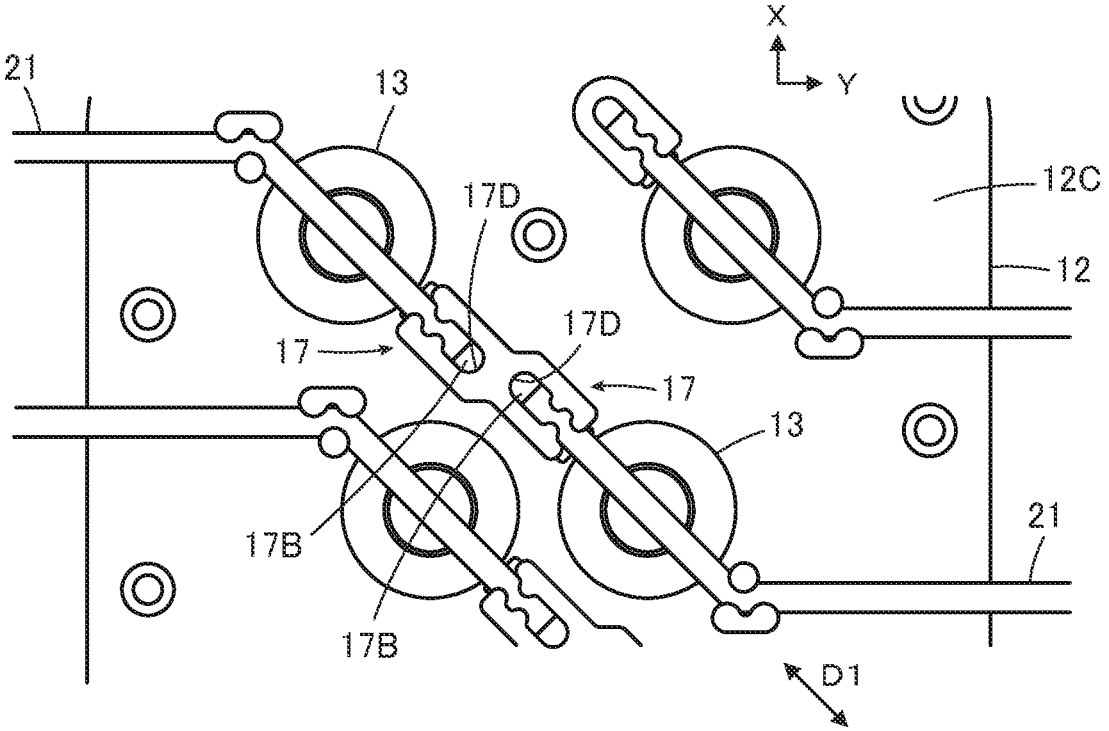
FIG. 15 is an enlarged partial view of FIG. 12.
Figure 16:
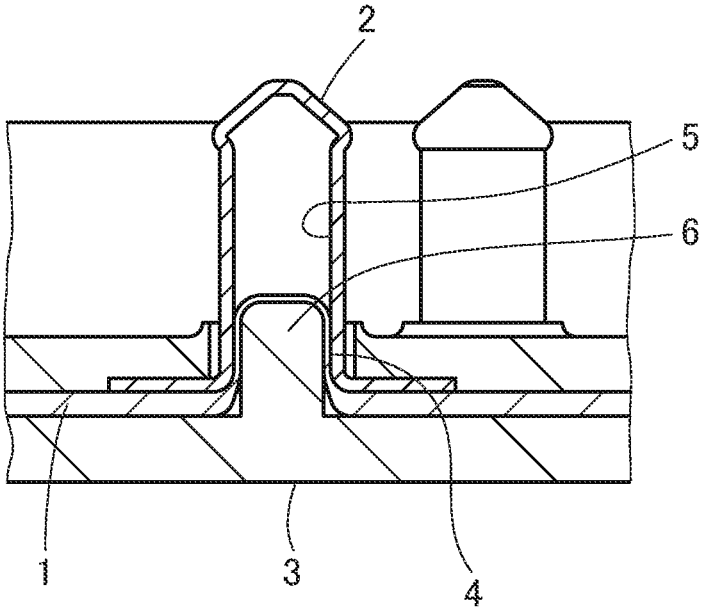
FIG. 16 PRIOR ART
FIG. 16 is a cross-sectional view showing a contact, a projection and a flexible substrate in a conventional connector.

As illustrated in FIG. 15, two first holding portions 17 corresponding to, of the plurality of contacts 13, two contacts 13 disposed to overlap each other in the first direction D1 are integrally formed, and one end portions of the corresponding flexible conductors 21 are accommodated in the conductor accommodating portions 17B of these two first holding portions 17B. However, since the conductor accommodating portions 17B of the two first holding portion 17 are isolated from each other via their partition walls 17D, the one end portions of the two flexible conductors 21 accommodated in these conductor accommodating portions 17B are prevented from being electrically short-circuited to each other.

Accordingly, with each of the plurality of flexible conductors 21 being disposed to extend across the opening end portion 13D of the projection accommodating portion 13C of the corresponding contact 13 and being held by the first holding portion 17 and the second holding portion 18, the base member 14 is pressed against the housing 12 from the −Z direction as illustrated in FIG. 4.

Therefore, while each of the projections 15 of the base member 14 is inserted into the projection accommodating portion 13C of the corresponding contact 13, since the flexible conductor 21 is disposed to extend across the opening end portion 13D of the projection accommodating portion 13C of the contact 13, the flexible conductor 21 is, together with the projection 15, drawn and inserted into the projection accommodating portion 13C of the contact 13. As a result, the flexible conductor 21 is sandwiched between a lateral surface of the projection 15 and an inner surface of the projection accommodating portion 13C of the contact 13, and contacts the inner surface of the projection accommodating portion 13C of the contact 13, whereby the contact 13 is electrically connected to the flexible conductor 21.

In addition, by pressing the base member 14 against the housing 12, the plurality of bosses 12D of the housing 12 are press-fitted into the plurality of boss accommodating holes 14C of the base member 14 to fix the housing 12 and the base member 14 to each other, and thus the connection process for connecting the connector 11 to the plurality of flexible conductors 21 is completed.

As above, since the flexible conductor 21 disposed to extend across the opening end portion 13D of the projection accommodating portion 13C of the contact 13 is held by the holding mechanism 16 including the first holding portion 17 and the second holding portion 18, the connector 11 can be readily connected to the flexible conductors 21 while a shift in positional relationship between each projection 15 and the corresponding flexible conductor 21 is prevented. As a result, the reliability of electrical connection of the connector 11 to the flexible conductors 21 can be assured.

The flexible conductor 21 disposed to extend across the opening end portion 13D of the projection accommodating portion 13C of the contact 13 is sandwiched and held by both the three protruding portions 17E of the first holding portion 17 and the three protruding portions formed by the three columnar portions 18A to 18C of the second holding portion 18 on the opposite sides of the contact 13. Therefore, when the flexible conductor 21 is, together with the projection 15, drawn and inserted into the projection accommodating portion 13C of the contact 13, even when a position of the flexible conductor 21 in the length direction thereof is shifted, the first holding portion 17 and the second holding portion 18 can hold the flexible conductor 21 while absorbing a positional shift of the flexible conductor 21.

Since the recessed portion 17F is formed at the bottom of the conductor accommodating portion 17B of the first holding portion 17, even when the projection height of the wall portion 17A from the housing-side facing surface 12C is not increased, one end portion of the flexible conductor 21 can be sufficiently accommodated in the conductor accommodating portion 17B, whereby the connector 11 can be reduced in thickness.

While the contact 13 is connected to the flexible conductor 21 made of a conductive yarn in the above-described embodiment, the invention is not limited thereto, and it is also possible to connect the connector 13 to a flexible conductor of a band shape.

While the flexible conductor 21 is not supported by, for example, an insulating substrate body and is independently disposed between the housing 12 and the base member 14 in the above-described embodiment, the invention is not limited thereto, and it is also possible to connect the connector according to the present invention to a flexible substrate of a band shape in which a flexible conductor is disposed to be exposed on the surface of the substrate body made of insulating material. However, in order to contact the flexible conductor exposed on the surface of the substrate body to the inner surface of the projection accommodating portion 13C of the contact 13 to establish electrical connection, the flexible substrate needs to be disposed between the base member 14 and the housing 12 such that the flexible conductor faces the housing-side facing surface 12C of the housing 12 and the rear surface of the substrate body faces the base member 14.

While the plug-type contacts 13 are used in the above-described embodiment, the invention is not limited thereto, and it is also possible to similarly configure a connector in which receptacle-type contacts are connected to the flexible conductors 21.

What is claimed is:

1. A connector to be connected to a flexible conductor, the connector comprising:

a base member having a projection;

a contact made of a conductive material and having a projection accommodating portion of a recess shape into which the projection is inserted; and a housing holding the contact, wherein the housing has a holding mechanism configured to hold the flexible conductor disposed to extend across an opening end portion of the projection accommodating portion of the contact, wherein the holding mechanism has a first holding portion and a second holding portion which are separately disposed on opposite sides of the opening end portion of the projection accommodating portion so as to sandwich the opening end portion of the projection accommodating portion of the contact, wherein one end portion of the flexible conductor is held by the first holding portion, and a middle portion of the flexible conductor is held by the second holding portion, and wherein when the projection of the base member is inserted into the projection accommodating portion of the contact together with the flexible conductor held by the holding mechanism, the flexible conductor is sandwiched between a lateral surface of the projection and an inner surface of the projection accommodating portion to contact the inner surface of the projection accommodating portion, whereby the contact is electrically connected to the flexible conductor.

2. The connector according to claim 1, wherein each of the first holding portion and the second holding portion has a plurality of protruding portions disposed on opposite sides of the flexible conductor in a width direction of the flexible conductor and protruding toward the flexible conductor, and wherein a gap between the plurality of protruding portions in the width direction of the flexible conductor is smaller than a width dimension of the flexible conductor.

3. The connector according to claim 2, wherein the plurality of protruding portions are disposed in positions different from each other in a length direction of the flexible conductor.

4. The connector according to claim 3, wherein the plurality of protruding portions comprise one protruding portion disposed on one side of the flexible conductor in the width direction of the flexible conductor and two protruding portions disposed on the other side of the flexible conductor in the width direction of the flexible conductor.

5. The connector according to claim 1, wherein the housing has a housing-side facing surface facing the base member, wherein the holding mechanism is disposed on the housing-side facing surface, and wherein the housing-side facing surface has a recessed portion inside the first holding portion, the recessed portion being recessed from a portion of the housing-side facing surface other than the first holding portion.

6. The connector according to claim 1, wherein the flexible conductor is disposed to extend across the opening end portion of the projection accommodating portion of the contact so that the one end portion extends toward an inside of the housing and the other end portion extends to an outside of the housing, wherein the housing has a partition wall disposed near the one end portion of the flexible conductor, and wherein the one end portion of the flexible conductor abuts the partition wall to limit movements of the flexible conductor to the one end portion.

7. The connector according to claim 6, comprising a plurality of the contacts held by the housing and connected to a plurality of the flexible conductors, wherein the base member has a plurality of the projections separately corresponding to the plurality of the contacts, and wherein the housing has a plurality of the holding mechanisms separately corresponding to the plurality of the contacts.

8. The connector according to claim 7, wherein the plurality of the holding mechanisms hold the plurality of the flexible conductors such that between a pair of the contacts adjacent to each other of the plurality of the contacts, a pair of the flexible conductors corresponding to the pair of the contacts extend in a direction crossing a straight line connecting the pair of the contacts.

9. The connector according to claim 1, wherein the flexible conductor is independently disposed on the housing.

10. The connector according to claim 1, wherein the flexible conductor is disposed to be exposed on a front surface of an insulating substrate body, and wherein the flexible conductor is disposed on the housing such that the flexible conductor faces the inner surface of the projection accommodating portion while a rear surface of the insulating substrate body faces the lateral surface of the projection.

11. The connector according to claim 1, wherein the contact is a plug-type contact.

12. The connector according to claim 1, wherein the contact is a receptacle-type contact.

* * * * *